US005826297A

United States Patent [19]

Footer et al.

[11] Patent Number: 5,826,297

[45] Date of Patent: Oct. 27, 1998

[54] DUSTPAN

[75] Inventors: Harold Footer, Newton; Robert Cann, Amherst, both of Mass.

[73] Assignee: Easy Day Manufacturing Co., Holliston, Mass.

[21] Appl. No.: 636,284

[22] Filed: Apr. 23, 1996

[51] Int. Cl.[6] ..... A47L 13/52

[52] U.S. Cl. ..... 15/257.2; 15/257.5; 15/257.9; D32/74

[58] Field of Search ..... 15/257.1, 257.2, 15/257.5, 257.8, 257.9; D32/74

[56] References Cited

U.S. PATENT DOCUMENTS

| | | | |
|---|---|---|---|
| D. 180,303 | 5/1957 | Timmons . | |
| D. 182,087 | 2/1958 | Sofro . | |
| 224,334 | 2/1880 | Heath . | |
| 226,877 | 4/1880 | Pierce . | |
| 279,676 | 6/1883 | Valentine . | |
| 302,075 | 7/1884 | Wickersham . | |
| D. 304,107 | 10/1989 | Noggle . | |
| 335,545 | 2/1886 | Squier . | |
| 340,146 | 4/1886 | Murphy . | |
| D. 347,915 | 6/1994 | Berti | D32/74 |
| D. 367,745 | 3/1996 | Feldman et al. | D32/74 |
| 371,973 | 10/1887 | Reichert . | |
| 396,668 | 1/1889 | Spicer . | |
| 422,240 | 2/1890 | Marshall . | |
| 450,670 | 4/1891 | Harlan . | |
| 510,762 | 12/1893 | Barber . | |
| 561,917 | 6/1896 | Rothrock . | |
| 565,059 | 8/1896 | Williams . | |
| 594,756 | 11/1897 | Ralph . | |
| 603,003 | 4/1898 | Black . | |
| 607,309 | 7/1898 | Weir . | |
| 621,683 | 3/1899 | Knight . | |
| 626,843 | 6/1899 | Richardson . | |
| 735,565 | 8/1903 | McCarthy . | |
| 851,441 | 4/1907 | Robinson . | |
| 861,195 | 7/1907 | Shank . | |
| 1,225,540 | 5/1917 | Wells | 15/257.5 |
| 1,376,012 | 4/1921 | Freeman . | |
| 1,659,461 | 2/1928 | Curran . | |
| 2,171,187 | 8/1939 | Millner . | |
| 2,553,727 | 5/1951 | Schlutz | 15/257.2 |
| 3,121,248 | 2/1964 | Ferguson | 15/257.9 |
| 3,156,941 | 11/1964 | Tomaiuolo . | |
| 4,483,560 | 11/1984 | Lordi . | |
| 4,802,258 | 2/1989 | Jensen . | |
| 5,407,089 | 4/1995 | Bird et al. | 15/257.1 |
| 5,457,844 | 10/1995 | Hanna et al. | 15/257.5 |

FOREIGN PATENT DOCUMENTS

| | | | |
|---|---|---|---|
| 2 594 676 A1 | 8/1987 | France . | |
| 2594676 | 8/1987 | France | 15/257.1 |
| 2410806 | 9/1975 | Germany | 15/257.8 |

*Primary Examiner*—David Scherbel
*Assistant Examiner*—Terrence R. Till
*Attorney, Agent, or Firm*—Wolf, Greenfield & Sacks, P.C.

[57] ABSTRACT

A dustpan includes a pan with a lip at one edge of the perimeter of the pan floor and a wall surrounding the perimeter of the pan floor from one end of the lip to the other. A grip and a generally U-shaped footplate are attached to the pan opposite the lip. A member can be attached to the rear end of the grip and the footplate. The grip and the footplate can be separated by a void. Several of the dustpans can be nested. The footplate can be attached to points on the outer wall that are separated by a curve in the outer wall.

34 Claims, 3 Drawing Sheets

DUSTPAN

BACKGROUND OF THE INVENTION

It is known to provide a footpiece at the back of a dustpan. This footpiece can enable a person to hold the dustpan with one foot while sweeping dirt, dust, shavings, leaves, and other waste materials into it, and thus avoid stooping. The footpiece can also allow the user to reposition the dustpan during use. It is further known to position the front end of the dustpan in such a way that stepping on the footpiece will hold the front edge of the pan firmly upon the floor.

Many prior art designs are quite old and employ multi-part metallic construction. More recently, a molded design has been proposed. None of the prior art approaches, however, is an optimal solution for receiving swept materials, especially when strength, versatility, and cost are taken into account.

SUMMARY OF THE INVENTION

According to one general aspect, the invention features a dustpan that includes a pan with a wall whose lower edge surrounds the perimeter of a pan floor from the first end of a lip to the second end of the lip. A grip is attached to the pan opposite the lip, and a generally U-shaped footplate has two ends attached to the pan opposite the lip. The dustpan also includes a member attached to the rear end of the grip and to the connector of the U-shaped footplate.

In another general aspect, the invention features a dustpan that includes a pan with an inner wall whose lower edge surrounds the perimeter of a pan floor from the first end of a lip to the second end of the lip. An outer wall surrounds at least one curve in the inner wall. A grip is attached to the pan opposite the lip, and a footplate has an end attached to a plurality of points on the outer wall of the pan generally opposite the lip. The points are separated by the curve in the outer wall.

In preferred embodiments, the pan and the footplate together form a convex shape having a center above the lip and the connector when the dustpan is placed on the floor. The footplate, the grip, and the member are all molded in a single piece, and teeth are located at the top of the wall. A resilient lip cover is mounted on the lip of the pan floor, and there is a friction-enhancing surface treatment on the top surface of the footplate. The grip includes a generally cylindrical channel with resilient biasing means to retain a broom in the channel which can provide the user a convenient way to store the pan with the broom. The ends of the footplate include outward extensions extending from the ends of the footplate along the curve of the outer wall and another curve of the outer wall. The outer wall extends down, at least to a height level with the pan floor at the curve and/or around the whole inner wall.

Dustpans according to aspects of the invention have the advantage of being quite sturdy, even when made using injection molding techniques. This sturdy geometry may even result in the dustpan being more lightweight than it might otherwise have been. Furthermore, the handle configuration and footplate provide versatile enhancements to the use of the dustpan.

DETAILED DESCRIPTION

Figure 1A:
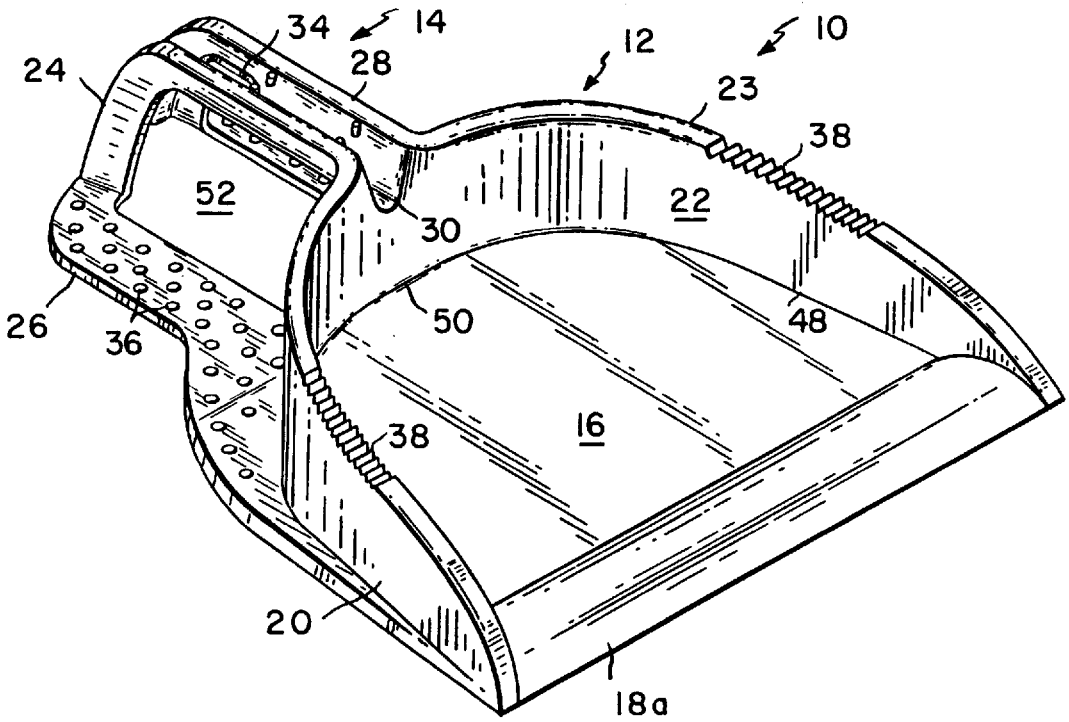
FIGS. 1A and 1B are perspective views of a dustpan according to the invention.
Figure 1B:
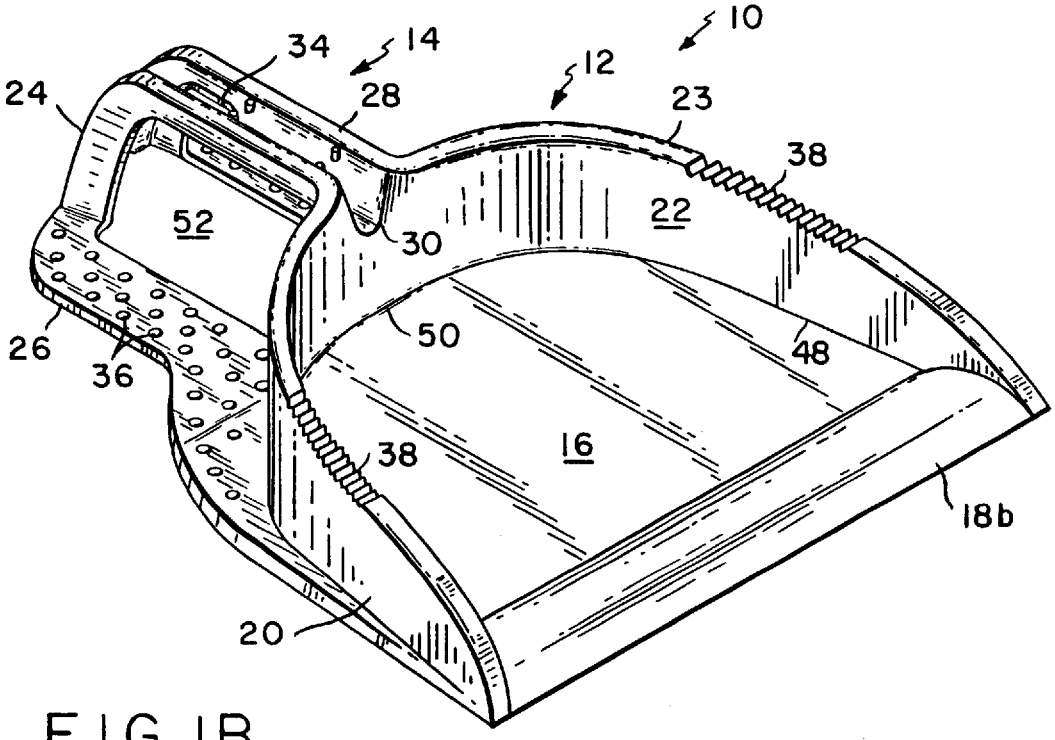
Figure 2:
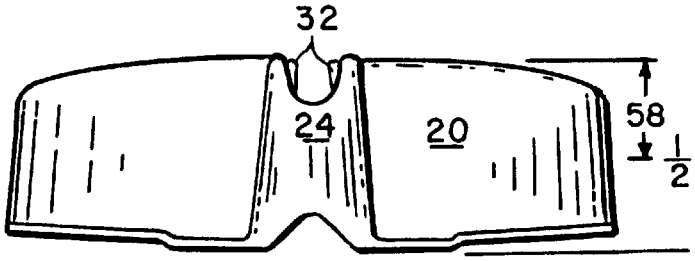
FIG. 2 is a rear plan elevation of the dustpan of FIG. 1A.

Referring to FIGS. 1A, 1B and 2–6, dustpan according to the invention generally includes a pan 12 and a handle 14. The pan has a pan floor 16 that is generally D-shaped. It has a straight lip 18 along one edge of its perimeter, two side edges 46, 48 that form a slightly acute angle with respect to the lip and end in respective curved edges 42, 44. Separating the curved edges is a back edge 50. This pan floor shape is not the only one which will provide benefits according to the invention. For example, the curved edges 42, 44 can exhibit different degrees of curvature, and can even form right angles. Furthermore, it is not necessary that the pan be symmetrical.

The pan 12 also includes an inner wall 22 that has an upper and a lower edge. The lower edge surrounds the perimeter of the pan floor from a first end of the lip 18 to a second end of the lip. In one embodiment, the inner wall forms a slightly obtuse angle with respect to the pan floor. Although molding considerations favor a slightly obtuse angle (e.g., a six degree draft angle), embodiments of the invention can employ other angles.

The pan also includes an outer wall 20 that surrounds the inner wall 22. This outer wall preferably surrounds the whole area of the inner wall, extending from a height level with the pan floor to the top of the inner wall, and forms an upper edge 23 where the inner and outer walls meet. This upper edge can bear a series of teeth 38 above each of the side edges 46, 48 of the perimeter of the pan floor 16. These teeth are for cleaning the user's broom when its bristles are brushed against them. As will be discussed in more detail below, the outer wall need not surround all surfaces of the inner wall, but it is beneficial for the outer wall to surround at least one of the curves in the inner wall, preferably while extending at least half way down to a height level with the pan floor such as to level 58. Stacking ribs 17 can be provided between the inner and outer walls to reinforce the structure and prevent stacked dustpans from becoming stuck together. Preferably those should be short, to allow efficient nesting, as discussed below.

The handle 14 includes a grip 28 that has a front end attached to the pan opposite the lip 18. The handle also includes a generally U-shaped footplate 26 that includes a connector 25 (e.g., a bend) and two ends (e.g., prongs), and the two ends are attached to the pan opposite the lip. The grip, the footplate, and the two ends are separated by a void 52. A member 24 also forms part of the handle and has a top end attached to the rear end of the grip and a bottom end attached to the connector of the footplate.

The grip 28 includes a channel 30 for storing the dustpan on the broom's handle. Inside the channel four resilient prongs 32 extend upward from the sides of the channel and provide a bias to grip the broom in the channel. A hole 34 sits near the rear end of the grip and allows the user to hang the dustpan.

The footplate 26 preferably has "pimples" or another surface treatment to increase friction between the footplate and a person's shoe and/or the floor. As shown in FIGS. 1A, 1B, 3, and 6, the ends of the U-shaped footplate can end in outward extensions 37 that prolong the length of the attachment between the footplate ends and the lower edge of the outer wall 20.

The dustpan 10 can be manufactured in one piece by injection molding. In one instance, the whole dustpan is made of a uniform 0.080 +/−5−10% inch thickness thermoplastic, but other materials and thickness dimensions can be employed and uniform thickness is not a requirement. Preferably the bottom edge of the pan 12 and the footplate 26 together form a convex shape 40, having a center above the lip and the connector when the dustpan is placed on the floor (see FIG. 4). Note that the center of the convex shape need not be precisely centered along the length of the dustpan. The lip can be a part of the injection molded structure (such as illustrated by lip portion 18*a*) or it can be a resilient lip attachment around a molded lip structure (e.g., an extruded elastomeric lip, (such as is illustrated by lip portion 18*b*)). This resilient lip provides a flexible surface that keeps the dustpan flush with the floor and further prevents sweepings from going under the pan during use.

In operation, the user places the dustpan 10 on the floor, steps on the footplate 26 and sweeps dust or other objects over the lip 18 into the pan 12. Because of the slightly convex shape 40 of the dustpan, the forward edge of the lip is pressed down toward the floor, and this helps to prevent dust from being pushed under the pan floor 16. The user can readily reposition the pan using his or her foot to guide the dustpan. The member 24 makes this easier by providing an additional rear surface for the user's foot to interact with.

The dustpan described above has the advantage that it can be made to be quite sturdy, even when injection molded to a minimal thickness. The sturdiness is provided at least in part by the fact that the outer wall 20 surrounds a curved portion of the inner wall 22, and that the footplate extensions 37 contact the lower edge of the outer wall at two separate locations and extend along the curve in the outer wall. In combination with the closed structure formed by the member 24 and grip 28, these structural features maintain a rigid structure despite minimal wall thickness. It is noted that the U-shaped footplate actually provides rigidity to the dustpan by acting in tension in this configuration.

Figure 4:
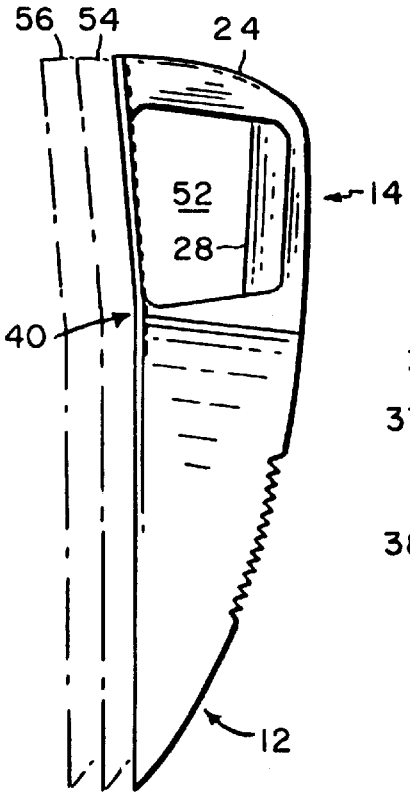
FIG. 4 is a left side elevation view of the dustpan of FIG. 1A stacked onto other similar dustpans shown in phantom.
Figure 3:
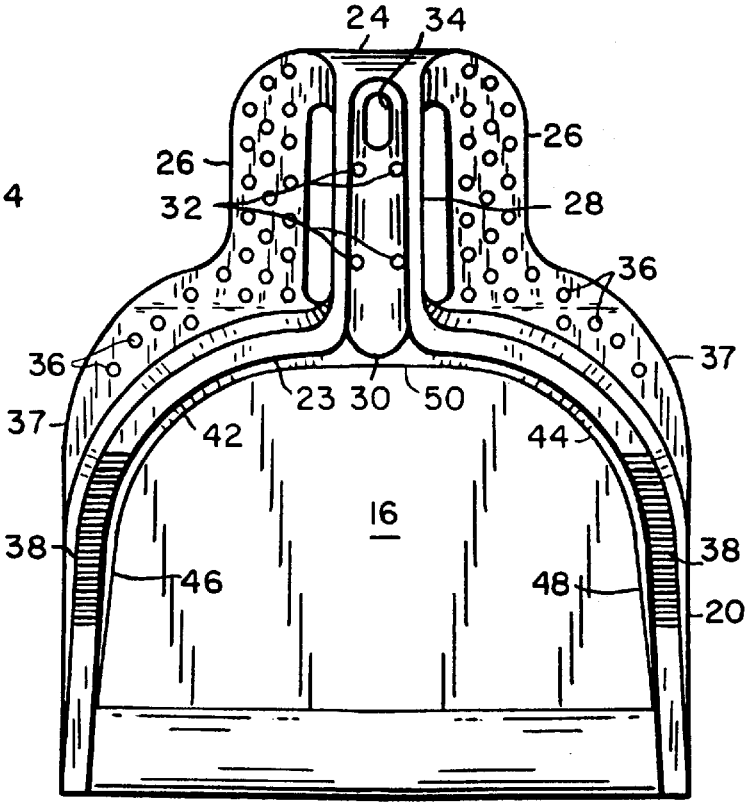
FIG. 3 is a top plan elevation of the dustpan of FIG. 1A.
Figure 5:
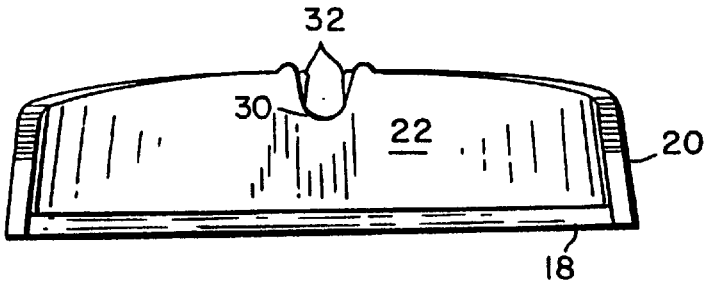
FIG. 5 is a front plan elevation of the dustpan of FIG. 1A.
Figure 6:
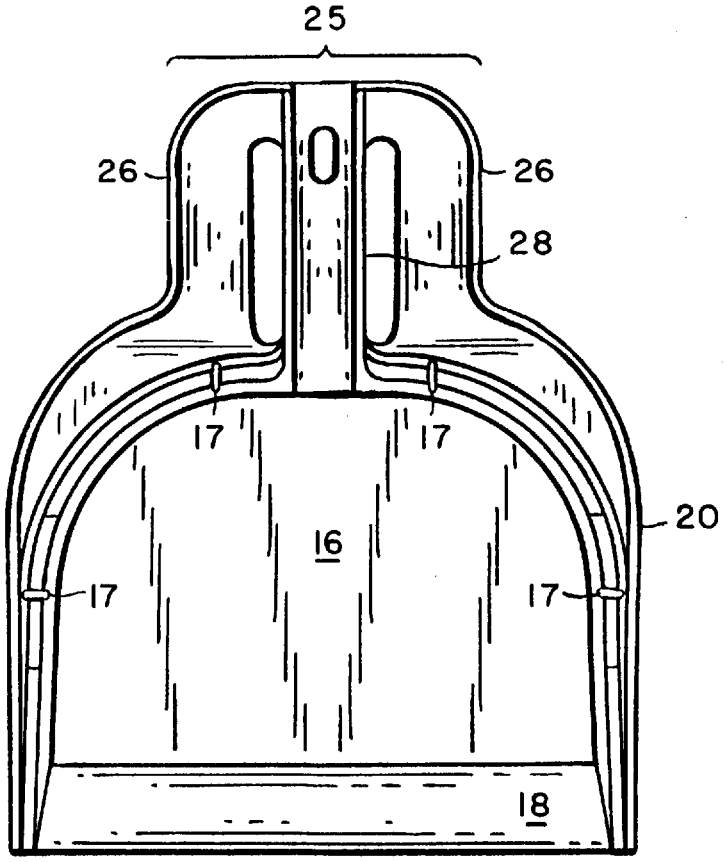
FIG. 6 is a bottom plan elevation of the dustpan of FIG. 1A.

The inner and outer wall and the step plate, grip, and member are also designed so that the dustpans can be nested together for shipping and in-store display purposes such as is shown for the dustpan 10 and 2 other dustpans 54, 56 shown in FIG. 4. In particular, voids such as void 52 in the upper surface of the dustpan correspond to protrusions such as the grip 28 in its lower surface, and protrusions in its upper surface correspond to voids in its lower surface. This feature can advantageously reduce freight costs and retail display space for the dustpan. Preferably, the structure should allow for at least a two-to-one reduction of height when the dustpans are nested as opposed to simply stacked. In one embodiment this reduction is over four-to-one.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. A dustpan, comprising:

a pan comprising:

a pan floor having a perimeter, and a lip at one edge of the perimeter of the pan floor, the lip having first and second ends, and a wall having an upper and a lower edge, the lower edge of the wall surrounding the perimeter of the pan floor from the first end of the lip to the second end of the lip, the wall forming an angle with the pan floor, a grip having front and rear ends, the front end of the grip being attached to the pan opposite the lip, a generally U-shaped footplate having a connector and two ends, the two ends being attached to the pan opposite the lip, the footplate having a top surface and a bottom surface, the grip and the footplate being separated by a void extending from the top surface of the footplate to the grip, and a member having a top end attached to the rear end of the grip and a bottom end attached to the connector of the footplate.

2. The dustpan of claim 1 wherein the pan and the footplate together form a convex shape having a center above the lip and the connector when the dustpan is placed on the floor.

3. The dustpan of claim 2 wherein the pan floor, the footplate, the wall, the grip, and the member are all molded in a single piece.

4. The dustpan of claim 3 wherein the grip includes a generally cylindrical channel and wherein the channel includes resilient biasing means to retain a broom handle in the channel.

5. The dustpan of claim 1 wherein the footplate, the grip, and the member are all molded in a single piece.

6. The dustpan of claim 1 further including a resilient lip cover mounted on the lip of the pan floor.

7. The dustpan of claim 1 further including a friction-enhancing surface treatment on the top surface of the footplate.

8. The dustpan of claim 1 wherein the grip includes a generally cylindrical channel.

9. The dustpan of claim 8 wherein the channel includes resilient biasing means to retain a broom handle in the channel.

10. A dustpan, comprising:

a pan comprising:

a pan floor having a perimeter, and a lip at one edge of the perimeter of the pan floor, the lip having first and second ends, and a wall having an upper and a lower edge, the lower edge of the wall surrounding the perimeter of the pan floor from the first end of the lip to the second end of the lip, the wall forming an angle with the pan floor, a grip having front and rear ends, the front end of the grip being attached to the pan opposite the lip, and a footplate having a proximal portion and a distal portion, the proximal portion being attached to the pan opposite the lip, a member having a top end attached to the rear end of the grip and a bottom end attached to the distal portion of the footplate, wherein upper and lower surfaces of the dustpan are shaped such that, when a plurality of dustpans are arranged atop one another, upper surfaces of the plurality of dustpans mate with lower surfaces of adjacent ones of the plurality of dustpans in a nesting relationship.

11. The dustpan of claim 5 wherein the upper and lower surfaces permit three of the dustpans to stack to less than twice a maximum height of each of the dustpans.

12. The dustpan of claim 10, wherein:

the footplate is generally U-shaped and includes a connector and two ends, the two ends being attached to the pan opposite the lip, and the bottom end of the member is attached to the connector of the footplate.

13. A dustpan, comprising:

a pan comprising:

a pan floor having a perimeter, and a lip at one edge of the perimeter of the pan floor, the lip having first and second ends, and a wall having an upper and a lower edge, the lower edge of the wall surrounding the perimeter of the pan floor from the first end of the lip to the second end of the lip, the wall forming an angle with the pan floor, a grip having front and rear ends, the front end of the grip being attached to the pan opposite the lip, a footplate having a proximal portion and a distal portion, the proximal portion of the footplate being attached to the pan opposite the lip, the footplate having a top surface and a bottom surface, the grip and footplate being separated by a void extending from the top surface of the footplate to the grip, and a member having a top end attached to the rear end of the grip and a bottom end attached to the distal portion of the footplate, the footplate extending beyond a width of the member.

14. A dustpan, comprising:

a pan comprising:

a pan floor having a perimeter, and a lip at one edge of the perimeter of the pan floor, the lip having first and second ends, and a wall having an upper and a lower edge, the lower edge of the wall surrounding the perimeter of the pan floor from the first end of the lip to the second end of the lip, the wall forming an angle with the pan floor, a grip having front and rear ends, the front end of the grip being attached to the pan opposite the lip, and a footplate having a proximal portion and a distal portion, the proximal portion of the footplate being attached to the pan opposite the lip, a member having a top end attached to the rear end of the grip and a bottom end attached to the distal portion of the footplate, and wherein upper and lower surfaces of the dustpan include voids and protrusions, wherein the voids and protrusions in the upper surface correspond respectively to protrusions and voids in the lower surface to enable nesting of a plurality of the dustpans.

15. The dustpan of claim 14 wherein the voids and protrusions permit three of the dustpans to stack to less than twice a maximum height of each of the dustpans.

16. The dustpan of claim 14, wherein:

the footplate is generally U-shaped and includes a connector and two ends, the two ends being attached to the pan opposite the lip, and the bottom end of the member is attached to the connector of the footplate.

17. The dustpan of claim 14, wherein the pan and the footplate together form a convex shape having a center above the lip and the connector when the dustpan is placed on the floor.

18. The dustpan of claim 14, wherein the pan floor, the footplate, the wall, the grip, and the member all are molded in a single piece.

19. A dustpan, comprising:

a pan comprising:

a pan floor having a perimeter, the pan floor having a lip at one edge of the perimeter of the pan floor, the lip having first and second ends, an inner wall having an upper and a lower edge, the lower edge of the inner wall surrounding the perimeter of the pan floor from the first end of the lip to the second end of the lip, the inner wall forming an angle with the pan floor, and an outer wall having a surface with at least one curve in the surface, and hang an upper edge attached to the upper edge of the inner wall, a grip having front and rear ends, the front end of the grip being attached to the outer wall of the pan opposite the lip, and a footplate attached at a first end to a plurality of points on the outer wall of the pan generally opposite the lip, wherein the plurality of points are separated by the curve in the outer wall.

20. The dustpan of claim 19 wherein the footplate is generally U-shaped and has a connector and a second end, the first and second ends of the footplate being attached to the pan opposite the lip.

21. The dustpan of claim 19 wherein the footplate includes outward extensions extending from the first end and a second end of the footplate extending respectively along the curve of the outer wall and another curve of the outer wall.

22. The dustpan of claim 19 wherein the outer wall extends down at least to a height level with the pan floor at the curve.

23. The dustpan of claim 19 wherein the outer wall extends down at least half way to a height level with the pan floor around the whole inner wall.

24. The dustpan of claim 19 wherein the outer wall extends down at least to a height level with the pan floor around the whole inner wall.

25. The dustpan of claim 19 wherein the pan and the footplate together form a convex shape having a center above the lip and the connector when the dustpan is placed on the floor.

26. The dustpan of claim 25 wherein the pan floor, the footplate, the inner wall, and the outer wall, the grip, are all molded in a single piece.

27. The dustpan of claim 19 wherein the footplate, and the grip, are all molded in a single piece.

28. The dustpan of claim 19 further including a plurality of teeth located at the top of the inner wall.

29. The dustpan of claim 19 further including a resilient lip cover mounted on the lip of the pan floor.

30. The dustpan of claim 19 wherein the grip includes a generally cylindrical channel.

31. The dustpan of claim 30 wherein the channel includes resilient biasing means to retain a broom handle in the channel.

32. The dustpan of claim 19 wherein upper and lower surfaces of the dustpan include voids and protrusions, wherein the voids and protrusions in the upper surface correspond respectively to protrusions and voids in the lower surface to enable nesting of a plurality of the dustpans.

33. The dustpan of claim 32 wherein the voids and protrusions permit three of the dustpans to stack to less than twice a maximum height of each of the dustpans.

34. The dustpan of claim 19 further including a member connected between the a portion of the footplate opposite the pan and a portion of the grip opposite the pan.

* * * * *

UNITED STATES PATENT AND TRADEMARK OFFICE

CERTIFICATE OF CORRECTION

PATENT NO. : 5,826,297

DATED : October 27, 1998

INVENTOR(S): Harold Footer and Robert Cann

It is certified that error appears in the above-identified patent and that said Letters Patent is hereby corrected as shown below:

IN THE CLAIMS

Column 4, line 61, please replace "5" with --10--.

Column 6, line 10, please replace "hang" with --having--.

Signed and Sealed this

Twenty-second Day of June, 1999

*Attest:*

Q. TODD DICKINSON

*Attesting Officer*

*Acting Commissioner of Patents and Trademarks*